US008387310B2

(12) United States Patent
Robalo et al.

(10) Patent No.: US 8,387,310 B2
(45) Date of Patent: Mar. 5, 2013

(54) SLIDING DOOR CARRIAGE, SLIDING DOOR DRIVING SYSTEM, VEHICLE AND METHOD OF MOUNTING A SLIDING DOOR DRIVING SYSTEM

(75) Inventors: Jean-Louis Robalo, Varennes Changy (FR); Michel Mounie, Saint Florent le Jeune (FR); Francois-Paul Meurou, Sceaux du Galinais (FR); Franck Rivoiret, Gien (FR)

(73) Assignee: Inteva Products France SAS (FR)

( * ) Notice: Subject to any disclaimer, the term of this patent is extended or adjusted under 35 U.S.C. 154(b) by 401 days.

(21) Appl. No.: 12/406,304

(22) Filed: Mar. 18, 2009

(65) Prior Publication Data

US 2009/0241425 A1 Oct. 1, 2009

(30) Foreign Application Priority Data

Mar. 26, 2008 (FR) ..... 08 01648

(51) Int. Cl.
*E05F 11/54* (2006.01)
*E05B 3/00* (2006.01)

(52) U.S. Cl. ..... 49/360; 49/352; 296/155

(58) Field of Classification Search ..... 49/352, 49/360, 209, 213, 214, 215; 296/155
See application file for complete search history.

(56) References Cited

U.S. PATENT DOCUMENTS

| | | | | |
|---|---|---|---|---|
| 4,559,740 | A * | 12/1985 | Tuchiya et al. | 49/216 |
| 5,746,025 | A * | 5/1998 | Shimura | 49/360 |
| 5,809,696 | A * | 9/1998 | Watanabe | 49/360 |
| 6,134,836 | A * | 10/2000 | Kawanobe et al. | 49/360 |
| 6,561,569 | B1 * | 5/2003 | Risdon et al. | 296/155 |
| 6,810,623 | B2 * | 11/2004 | Messlez et al. | 49/374 |
| 2002/0112404 | A1 * | 8/2002 | Au Truong | 49/360 |
| 2004/0216383 | A1 * | 11/2004 | Rogers et al. | 49/360 |
| 2004/0221510 | A1 * | 11/2004 | Fukumoto et al. | 49/360 |
| 2004/0221511 | A1 * | 11/2004 | Rogers et al. | 49/360 |
| 2005/0279025 | A1 * | 12/2005 | Suzuki | 49/360 |
| 2006/0113821 | A1 | 6/2006 | Yokomori et al. | |

FOREIGN PATENT DOCUMENTS

EP 1630342 3/2006

OTHER PUBLICATIONS

French Search Report and Written Opinion and Translation dated Nov. 3, 2008.

* cited by examiner

*Primary Examiner* — Katherine W Mitchell
*Assistant Examiner* — Justin Rephann
(74) *Attorney, Agent, or Firm* — Cantor Colburn LLP

(57) ABSTRACT

A sliding door carriage for a vehicle includes a first point for fixing a first cable strand for driving in a first direction, and a second point for fixing a second cable strand for driving in a second direction. Each fixing point is offset toward a rear of the sliding door carriage relative to a direction of driving by the respective cable strand. The sliding door carriage can be included in a sliding door driving system, and the sliding door driving system can be included in a vehicle. The bulk of the sliding door driving system in a body of a vehicle can be reduced.

28 Claims, 4 Drawing Sheets

SLIDING DOOR CARRIAGE, SLIDING DOOR DRIVING SYSTEM, VEHICLE AND METHOD OF MOUNTING A SLIDING DOOR DRIVING SYSTEM

REFERENCE TO RELATED APPLICATION

This application claims priority to France Patent Application No. 0801648 filed Mar. 26, 2008.

BACKGROUND OF THE INVENTION

The present invention relates to a sliding door carriage. The sliding door carriage is intended to be used in particular in a sliding door driving system for motor vehicles.

Vehicles, such as the vehicle from the company Volkswagen referenced Multivan (registered trademark) or even vehicles from the company Peugeot reference 807 (registered trademark), have a sliding rear door. A sliding door is guided by three substantially horizontal rails along a body: one situated above a frame of a door, another situated below the frame of the door, and the third situated on a back of the body at an intermediate height relative to the other two rails. Three guide carriages fixed to the sliding door are each adapted to slide in one of the rails and make it possible to slide the sliding door along the body. The sliding door is driven by a motorized driving system. This driving system includes the intermediate rail, a carriage, two cable strands that are fixed to the carriage, the cable strands being driven by an electric motor, and two transmitters defining a cable path. The cable strands are each fixed to one end of the carriage, at the front of the carriage relative to the direction of movement of the carriage. The transmitters are fixed to the body, each at one end of the rail, on a longitudinal axis of the rail. The distance between the transmitters is substantially equal to a length of the rail. Thus, for a door travel equal to the length of the rail, the overall bulk of the driving system corresponds to the sum of the lengths of the rail and of the two transmitters situated beyond its ends. One drawback of this type of driving system is that it is bulky.

There is therefore a need for a sliding door carriage for vehicles which makes it possible to reduce the bulk of the sliding door driving system.

SUMMARY OF THE INVENTION

A sliding door carriage includes a first point for fixing a first cable strand for driving in a first direction, a second point for fixing a second cable strand for driving in a second direction. Each fixing point is offset toward a rear of the sliding door carriage relative to a direction of driving by the respective cable strand.

According to a particular feature, the sliding door carriage includes two grooves suitable for each accommodating a cable strand. According to a particular feature, the sliding door carriage includes a device for guiding the sliding door carriage along a rail, a cable support including fixing points for the cable strands. The cable support is fixed to the guide device by an attachment feature. According to a particular feature, the guide device includes the attachment features, and the attachment features are tabs suitable to be deformed to fix the cable support to the guide device. According to a particular feature, each fixing point is linked to the sliding door carriage by a tensioner.

The invention also relates to a sliding door driving system for vehicles including a gear motor, a sliding door carriage as described above, and a sliding door cable for driving the sliding door carriage including two strands. The cable is suitable to be driven by the gear motor, the cable strands crossing at the sliding door carriage.

According to a particular feature, the driving system also includes two transmitters defining a cable path, the sliding door carriage being opposite one of the transmitters when the sliding door carriage is in a limit position. According to a particular feature, the driving system also includes a carriage guide rail including two piercings through each of which passes a cable strand situated in the extension of one of the fixing points.

The invention also relates to a vehicle including the driving system as described above, a sliding door driven sliding-wise by the driving system, and the sliding door carriage is fixed to the sliding door.

The vehicle also relates to a method of mounting a sliding door driving system including the steps of providing a guide device, providing a cable support including a first point for fixing a first cable strand for driving in a first direction and a second point for fixing a second cable strand for driving in a second direction, each fixing point being offset toward a rear of the sliding door carriage relative to the direction of driving by the respective cable strand, providing a cable including two strands, inserting the cable support into the guide device, fixing the cable support to the guide device of the sliding door carriage, and fixing the cable strands to the sliding door carriage.

According to a particular feature of the method of mounting the sliding door driving system, the guide device includes attachment features that are tabs suitable to be deformed to fix the cable support to the guide device. The step for fixing the cable support to the guide device includes a step for deforming the attachment tabs to fix the cable support to the guide device.

BRIEF DESCRIPTION OF THE DRAWINGS

Other features and benefits of the invention will become apparent from reading the detailed description that follows of the embodiments of the invention given solely by way of example and with reference to the drawings which show.

DETAILED DESCRIPTION OF THE PREFERRED EMBODIMENT

Conventionally, there are defined a direction X in which a vehicle moves, a vertical direction Z, and a lateral direction Y perpendicular to the axes X and Z. The terms "up," "down," "top," and "bottom" are defined relative to the axis Z. A front and a rear of the vehicle are defined relative to a direction of progress of the vehicle.

The front and the rear of a carriage, a guide device, and a cable support are defined generally relative to the view of FIGS. 2 to 5. A front face of the carriage, the guide device, and the cable support is the face that faces the reader. A rear face of the carriage, the guide device, and the cable support is the face opposite to the front face. The front and the rear of the carriage can also be defined relative to the direction of progress or of driving of the carriage when the latter is driven by a driving cable strand. The direction of progress of the carriage is in the direction X when the carriage is mounted on a vehicle. The references that are identical in the various figures represent similar elements.

There is proposed a sliding door carriage for vehicles including two cable strand fixing points. A first point is for fixing a first cable strand for driving the slider door carriage in a first direction. A second point is for fixing a second cable strand for driving the slider door carriage in a second direction.

Each fixing point is offset toward a rear of the slider door carriage relative, respectively, to the first driving direction or to the second driving direction. Thus, the slider door carriage is no longer pulled from the front relative to the direction of progress of the slider door carriage, as in the prior art described above, but by a point offset toward the rear of the slider door carriage relative to the direction of progress of the slider door carriage.

In this way, transmitters can be located opposite limit positions of the slider door carriage, these limit positions corresponding to the fully open and closed positions of a sliding door. This makes it possible to reduce a distance between the transmitters. In practice, the distance between the transmitters is substantially equal to a distance traveled by the carriage between the open and closed positions of the door. Thus, a length of the rail plus transmitters assembly is substantially equal to the length of the rail. The bulk of the sliding door driving system is therefore reduced.

Figure 1:
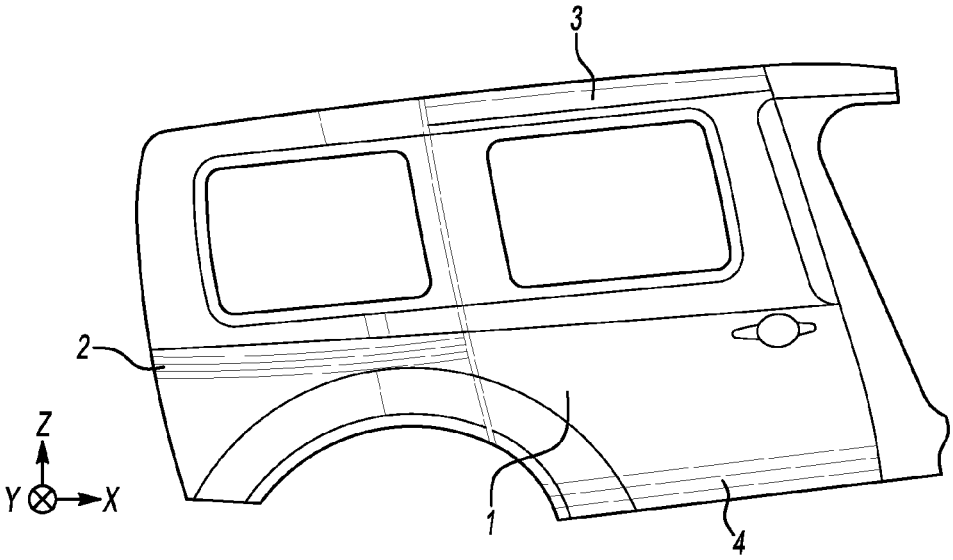
FIG. 1 illustrates a partial schematic view of a motor vehicle fitted with a sliding door.

FIG. 1 represents a partial schematic view of a motor vehicle as proposed, fitted with a sliding door. The motor vehicle represented in FIG. 1 includes a sliding rear door 1 sealing a door frame. The sliding rear door 1 slides between an open position and a closed position. In the open position, the door frame is completely freed. In the closed position, the door frame is completely blocked by the sliding rear door 1. The sliding rear door 1 is adapted to slide along guide rails situated on a body shell of the vehicle. For this, the sliding rear door 1 is fitted with guide carriages, each guide carriage sliding in a guide rail.

The vehicle represented in FIG. 1 includes three rails 2, 3 and 4. The rails 2, 3, 4 are substantially extending in the direction X. The top rail 3 and the bottom rail 4 are situated on the body shell of the vehicle, respectively, above and below the door frame. The top rail 3 and the bottom 4 are situated inside the vehicle when the sliding rear door 1 is closed. The third rail 2 is an intermediate rail. It is situated at a height between the top rail 3 and the bottom rails 4. The intermediate rail 2 is on an external body of the vehicle, at the rear of the sliding rear door 1 when it is closed.

The sliding rear door 1 of the vehicle is adapted to be operated electrically. In particular, the user can open or close the sliding rear door 1 by pressing an actuating button. The actuating button is, for example, situated on a door handle or inside the sliding rear door 1 or on a remote control. The actuating button initiates the starting up of a door driving system. The starting up of the door driving system can also be triggered by a push on the sliding rear door 1 by the user. The driving system includes in particular the intermediate rail 2 and a sliding door carriage 5 which slides in the intermediate rail 2. The door driving system is motorized. A driving system as proposed will be described below.

Figure 2:
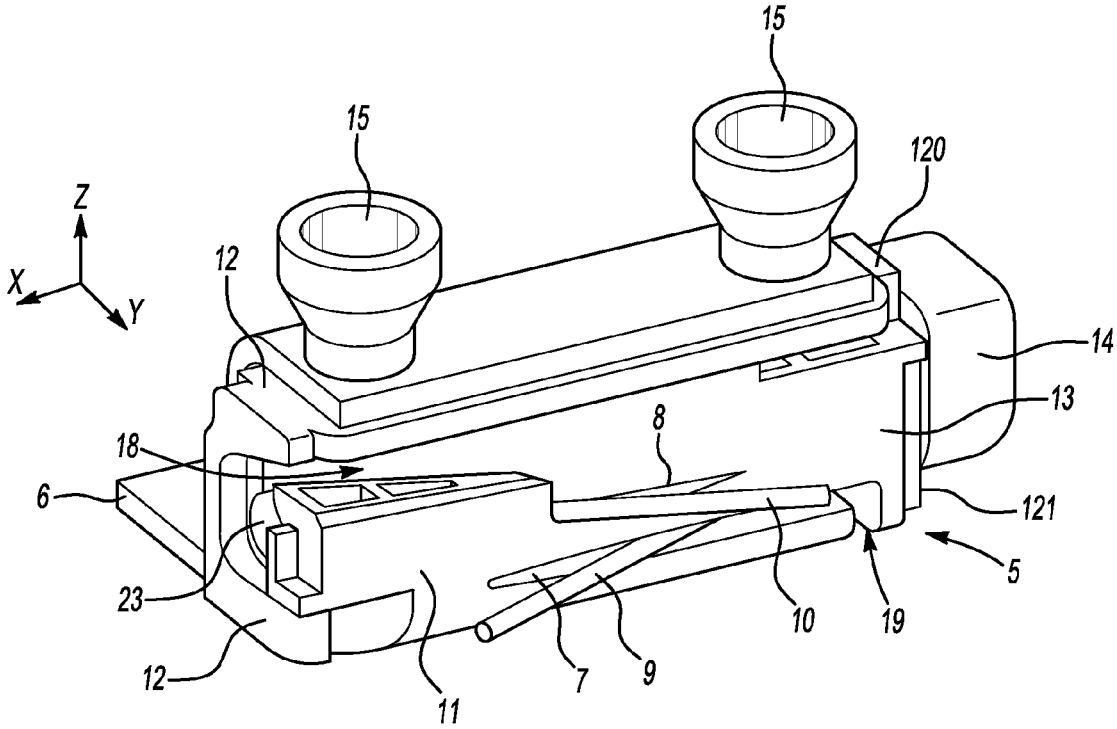
FIG. 2 illustrates a perspective view of a carriage.

FIG. 2 represents a perspective view of a sliding door carriage 5 according to a first embodiment of the invention. The sliding door carriage 5 is adapted to be part of a sliding door driving system. In particular, the sliding door carriage 5 is adapted to slide in a rail by being driven by a transmission cable. The rail defines a door guide direction. When the rail is mounted on a vehicle, the door guide direction is along the axis X.

The sliding door carriage 5 is adapted to be fixed (for example, by an articulation) to a sliding door for vehicles, for example a motor vehicle as represented in FIG. 1. For this, the sliding door carriage 5 includes a fixing tab 6. The fixing tab 6 is fixed to the sliding door carriage 5, for example by screwing. As a variant, the fixing tab 6 can be an integral part of the sliding door carriage 5. The sliding door carriage 5 is of substantially parallelepipedal form. The sliding door carriage 5 has an elongate shape in the door guide direction.

The sliding door carriage 5 includes two fixing points 22 and 23 (the fixing point 22 can be seen in particular in FIGS. 3 and 9) for fixing two cable strands. A first fixing point 22 is for fixing a first cable strand 9, and a second fixing point 23 is for fixing a second cable strand 10. The first cable strand 9 is adapted to drive the sliding door carriage 5 in a first direction, and the second cable strand 10 is adapted to drive the sliding door carriage 5 in a second direction. The first direction and the second direction are in the door guide direction.

Each fixing point 22 and 23 is offset toward a rear of the sliding door carriage 5 relative, respectively, to the first driving direction or to the second driving direction. Thus, the sliding door carriage 5 is pulled by the first cable strand 9 or by the second cable strand 10 from the rear of the sliding door carriage 5 relative to the direction of progress of the sliding door carriage 5. This makes it possible, as explained above, to reduce the bulk of the sliding door driving system.

Figure 5:
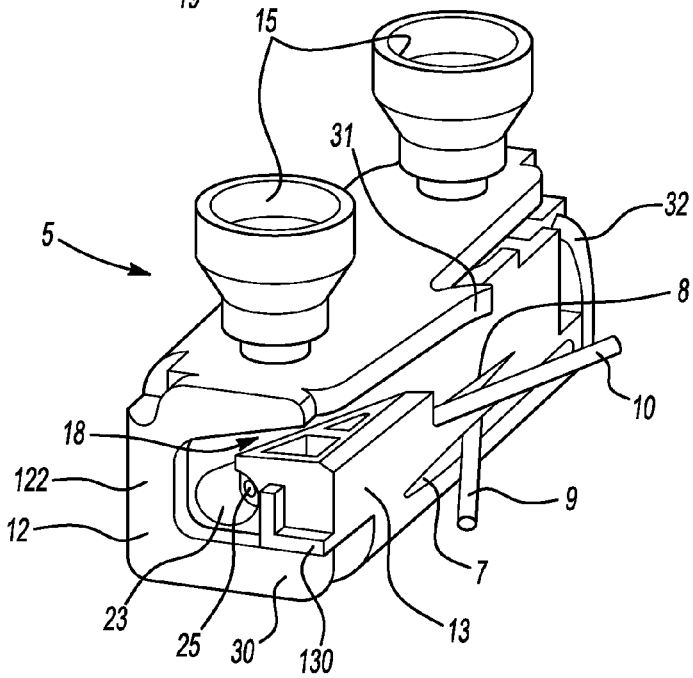
FIG. 5 illustrates another perspective view from a side of the carrier according to another embodiment.

Each cable strand 9 and 10 terminates at its end inserted into the sliding door carriage 5 by a socket 25 (FIG. 5). The socket 25 is, for example, crimped onto the end of the cable strand 9 and 10. Each fixing point 22 and 23 is, for example, a recess for accommodating and maintaining the sockets 25 for fixing the cable strands 9 and 10 in the sliding door carriage 5.

The sliding door carriage 5 includes two grooves 7 and 8 designed each to accommodate a cable strand 9 and 10, respectively. The grooves 7 and 8 are situated in separate planes, which can be parallel. Once the sliding door carriage 5 is mounted on a vehicle, the grooves 7 and 8 are, respectively, located in two separate planes (X, Y) situated at different heights. The first groove 7, designed to accommodate the first cable strand 9, is, for example, situated in a bottom plane. The second groove 8, designed to accommodate the second cable strand 10, is, for example, situated in a top plane.

The sliding door carriage 5 also includes spaces 18 and 19 for inserting the cable strands 9 and 10 in the fixing points 22 and 23 and in the grooves 7 and 8. The cable strand 9 inserted into the first groove 7 (the bottom groove) is inserted into the sliding door carriage 5 through a space 19 (which can be seen in particular in FIG. 3) accessible via the bottom of the sliding door carriage 5. The cable strand 10 inserted into the second groove 8 (the top groove) is inserted into the sliding door carriage 5 through the space 18 that can be accessed via the top of the sliding door carriage 5.

The grooves 7 and 8 are preferably positioned in such a way that the cable strands 9 and 10 cross at the level of the sliding door carriage 5. Thus, the projections of the straight lines passing through the grooves 7 and 8 in a plane parallel to those of the grooves cross over. The crossing can take place inside the sliding door carriage 5, on a face of the sliding door carriage 5, or even outside the sliding door carriage 5, depending on the angle between the projections of the straight lines passing through the grooves 7 and 8. Thus, the cable strands 9 and 10, once inserted into the grooves 7 and 8 of the sliding door carriage 5, cross over, at different heights, either inside the sliding door carriage 5, on a face of the sliding door carriage 5, or outside the sliding door carriage 5. In these three cases, the crossing over of the cable strands 9 and 10 takes place near the level of the sliding door carriage 5, that is, in the sliding door carriage 5 or close to the sliding door carriage 5. The axes of the grooves 7 and 8 thus form a non-zero angle with the guide direction of the sliding door carriage 5.

An X-shaped cable path is then defined by the grooves 7 and 8. Thus, the two cable strands 9 and 10, once inserted into the sliding door carriage 5, cross over without touching. This makes it possible to avoid any friction of one cable strand on the other while the sliding door driving system is operating.

The grooves 7 and 8 both culminate on the same face 11 of the sliding door carriage 5. The face 11 is called front face. Thus, the two cable strands 9 and 10, once inserted into the sliding door carriage 5, leave the sliding door carriage 5 through the face 11. The face 11 is in a plane (X, Z) when the sliding door carriage 5 is mounted on the vehicle.

Figure 6:
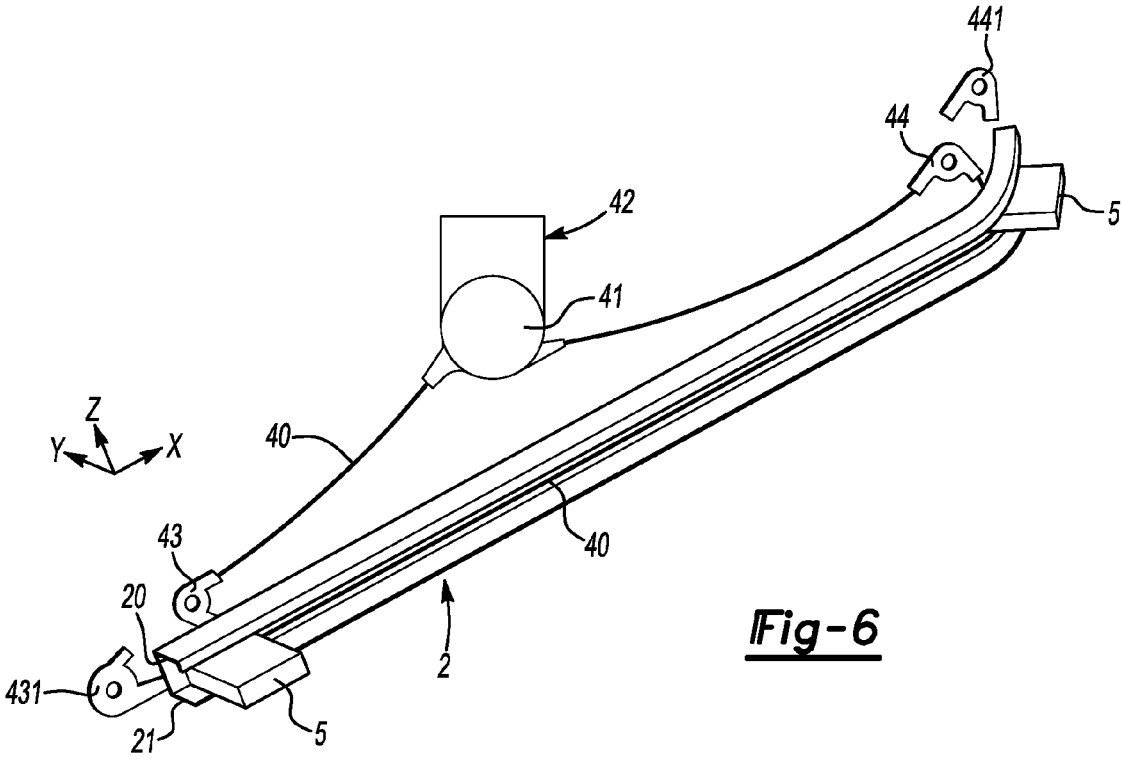
FIG. 6 illustrates a perspective view of a driving system.

The sliding door carriage 5 is adapted to slide on a rail between two limit positions. In particular, the face 11 of the sliding door carriage 5 is adapted to be mounted opposite a sliding rail. Two transmitters define a cable path. When the sliding door carriage 5 is mounted on the vehicle, the sliding door carriage 5 is in a limit position when the sliding door is in the fully open position or the closed position. When the sliding door carriage 5 is in one of the limit positions, the sliding door carriage 5 is opposite one of the transmitters 44 and 43, as represented in FIG. 6. This means that, in the fully open position or the closed position of the sliding rear door 1, the plane of the rail at the level of the transmitter 43 and 44 is substantially perpendicular to an axis of the transmitter 43 and 44. The sliding door carriage 5 as proposed makes it possible to reduce the distance that separates the transmitters 43 and 44 compared to the prior art in which the transmitters 431 and 441, as represented in FIG. 6 are fixed, each at one end of the rail on the longitudinal axis of the rail. The distance between the transmitters 431 and 441 is therefore substantially equal to the length of the rail. Thus, in the prior art, for a travel of the door equal to the length of the intermediate rail 2, the overall bulk of the driving system of the prior art corresponds to the sum of the lengths of the intermediate rail 2 and of the two transmitters 431 and 441 situated beyond its ends. Thus, in the invention, the bulk of the driving system including the sliding door carriage 5, the rail and the transmitters 43 and 44 is therefore reduced. In particular, if the rail is linear, the distance between the transmitters 43 and 44 is substantially equal to the distance traveled by the sliding door carriage 5 between the limit positions, that is between the open position and the closed positions of the sliding rear door 1.

To make it easier for the reader to understand, the sliding door carriage 5 will now be described when mounted on a vehicle. This should not be taken as a limitation. The sliding door carriage 5 includes a guide device 12 and a cable support 13. The cable support 13 includes the fixing points 22 and 23. The cable support also includes the grooves 7 and 8.

The space 18 for insertion of the cable strand 9 into the groove 7 is situated between a top face 120 of the guide device 12 and the cable support 13. The space 19 for insertion of the cable strand 10 into the groove 8 is situated in a bottom part of the cable support 13.

In one embodiment, the cable support 13 is an integral part of the guide device 12. In another embodiment, the cable support 13 is fixed to the guide device 12, for example by gluing or screwing. This makes it possible, in particular, to adapt a carriage conventionally used in the prior art in order to reduce the bulk of the driving system. For this, a cable support 13 provided with fixing points 22 and 23 is inserted into a conventional carriage formed by a guide device 12. The addition of the cable support 13 to an existing guide device 12 makes it possible to improve the carriage by reducing the bulk of the driving system in the body by adding to the conventional carriage the function for driving the carriage via a point offset toward the rear of the carriage relative to the driving direction of the carriage. This is achieved by the offset positioning, toward the rear of the carriage relative to the driving direction of the carriage, of the fixing points. Also added is the cable strand crossing function. This is achieved by the positioning of the grooves relative to each other.

The sliding door carriage 5 includes two top guide rollers 15. The top guide rollers 15 are fixed to a top face 120 of the guide device 12, for example by screwing or riveting. The top face 120 of the guide device 12 is in the plane (X, Y). The top guide rollers 15 are adapted to cooperate with a rail top part 20, which can be seen in particular in FIG. 6. The top part 20 of the rail is folded back on itself. The top guide rollers 15, inserted into the fold formed in the top part 20 of the rail, prevent in particular the tilting of the sliding door carriage 5 in the direction Y (see in particular FIG. 6). The top guide rollers 15 have a substantially inverted-cone shape. The top guide rollers 15 have, for example, a vertical axis of revolution. The top guide rollers 15 are adapted to revolve about their axis against the fold of the top part 20 of a rail, so as to facilitate the guiding of the sliding door carriage 5 along the rail.

The sliding door carriage 5 also includes an end stop 14 situated on a lateral face 121 of the sliding door carriage 5. The lateral face 121 of the sliding door carriage 5 is situated in the plane (Y, Z). The end stop 14 is situated on the rear side of the vehicle. This end stop thus serves as a mechanical end stop to the sliding door carriage 5 when the latter arrives in the limit position corresponding to the sliding door open position. The end stop 14 can, for example, abut against an end of the rail. The end stop 14 is fixed in the lateral face 121, for example, by screwing through a piercing 26 (FIG. 4) passing through the lateral face 121, or can be of a single piece.

Figure 8:
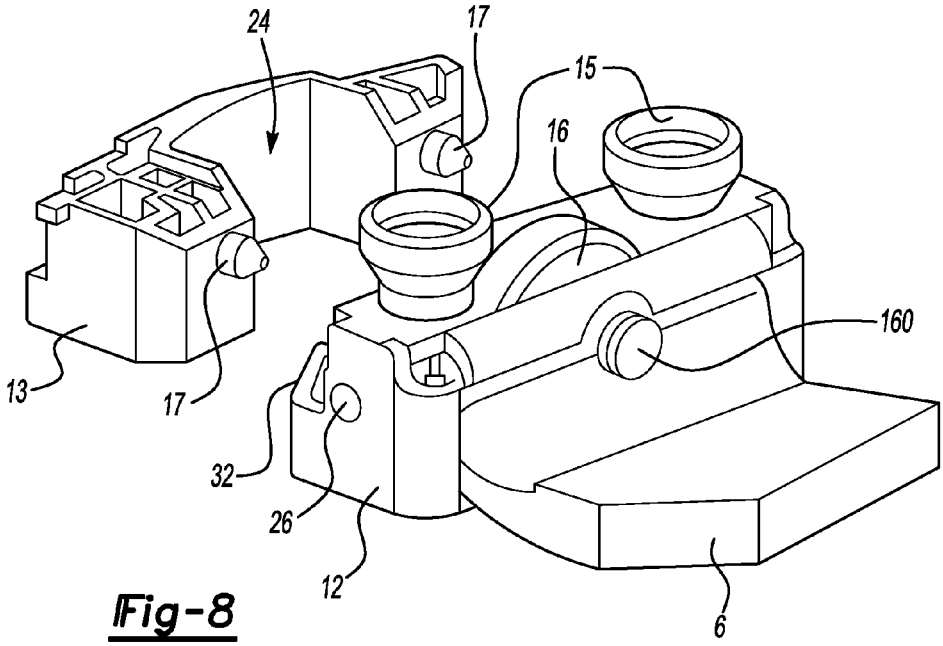
FIG. 8 illustrates an exploded view of the carriage according to another embodiment.

The sliding door carriage 5 also includes a bottom guide roller 16. The bottom guide roller 16 can be seen in particular in FIG. 3. The bottom guide roller 16, although not visible in FIG. 2, is present on the sliding door carriage 5 according to the embodiment of FIG. 2. This bottom guide roller 16 has an axis of symmetry which is along the axis Y. The bottom guide roller 16 is in the form of a disk and is adapted to revolve about its axis. The bottom guide roller 16 is adapted to bear against the bottom part 21 of a rail, which can be seen in particular in FIG. 6, which is on a plane (X, Y). The bottom guide roller 16 is adapted to support the weight of the sliding door carriage 5 plus a part of the weight of the door. The sliding door carriage 5 rests on the bottom part of the rail only through the intermediary of the bottom guide roller 16. The bottom guide roller 16 is adapted to facilitate the transfer of the sliding door carriage 5 along a rail. The sliding door carriage 5 includes a space 24 (FIG. 3) between the guide device 12 and the cable support 13, making it possible to house the bottom guide roller 16. The bottom guide roller 16 is fixed to a rear face 125 (FIG. 3), called rear face, of the sliding door carriage 5. The rear face 125 is in a plane (X, Z). The rear face 125 is opposite to the front face 11. The bottom guide roller 16 is, for example, fixed to the rear face 125 by a screw or rivet 160 (FIG. 8). The bottom guide roller 16 can be fixed to the front face or by both the front face and the rear face. The fixing tab 6 for fixing to a sliding door can be an integral part of the guide device 12 or be fixed to the guide device 12, for example, by screwing.

Figure 3:
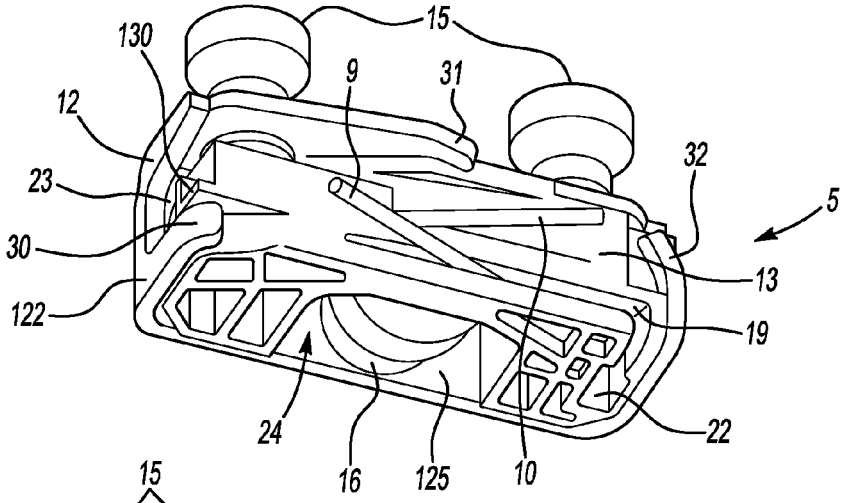
FIG. 3 illustrates a perspective views from below the carriage according to another embodiment.
Figure 4:
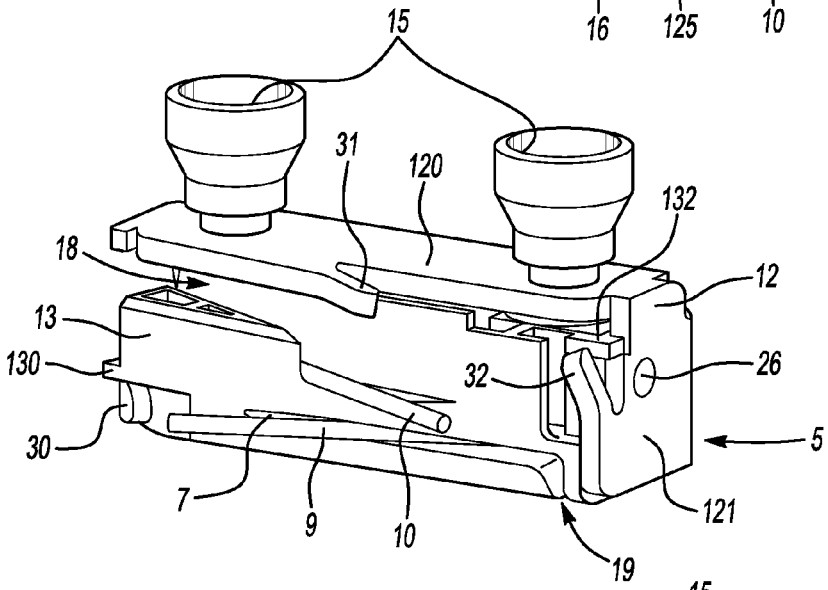
FIG. 4 illustrates a perspective view from a side of the carriage according to another embodiment.

FIGS. 3 to 5 represent perspective views from below and from the side of a sliding door carriage 5 according to another embodiment. FIG. 8 represents an exploded view of the sliding door carriage 5 according to the second embodiment of the invention. All that has been described hereinabove regarding FIG. 2 is also valid for the embodiment of FIGS. 3 to 5 and 8. In the embodiment of FIGS. 3 to 5 and 8, the guide device 12 and the cable support 13 are two separate parts.

The cable support 13 is then fixed to the guide device 12. The fixing is made by attachment features 30, 31 and 32. Preferably, the attachment features are adapted to enable a fixing with no additional fixing features, for example without glue or without screws. The attachment features are, for example, attachment tabs 30, 31 and 32. The attachment tabs 30, 31 and 32 are an integral part of the guide device 12. When mounting the sliding door carriage 5, the cable support 13 is inserted into the guide device 12, then the attachment tabs 30, 31 and 32 are deformed to serve as lugs and hold the cable support 13 in position in the guide device 12. In the embodiment of FIGS. 3 to 5 and 8, the guide device 12 includes three attachment tabs, but it could include more or fewer thereof, from the moment that the fixing is made and can withstand a use throughout the life of the vehicle.

A first attachment tab 30 is on a lateral face 122 of the guide device 12 opposite to the face 121. Before deformation, it is in the direction Y. The first attachment tab 30 is deformed by exerting a pressure in the direction X toward the inside of the sliding door carriage 5. When it is deformed, the first attachment tab 30 is placed under a shoulder 130 of the cable support 13 to hold the cable support 13 from below.

A second attachment tab 31 is on the top face 120 of the guide device 12. Before deformation, it is in the direction X. The second attachment tab 31 is deformed by exerting a pressure in the direction Z downward. When it is deformed, the second attachment tab 31 is placed in front of the front face 11 of the cable support 13 to hold the cable support 13 from the front.

A third attachment tab 32 is on the lateral face 121 of the guide device 12. Before deformation, it is in the direction Z. The third attachment tab 32 is deformed by exerting a pressure in the direction X, toward the inside of the sliding door carriage 5. When it is deformed, the third attachment tab 32 is placed in front of a shoulder 132 of the cable support 13 to hold the cable support from the front.

The material used for the attachment tabs 30, 31 and 32 should not be too hard for the deformation of the attachment tabs 30, 31 and 32 to be able to be done by a user without having to apply to much effort, for example manually or using a tool of pliers type or using a crimping machine. The material must also not be too soft for the tabs to remain deformed in the same position throughout the life of the vehicle.

Thus, the cable support 13 is fixed in the guide device 12 without any ancillary fixing features, for example without glue or without screws, which facilitates the mounting of the sliding door carriage 5.

The attachment tabs 30, 31 and 32 also make it possible to fix the cable support 13 in the guide device 12 in a tight-fitting manner. The absence of play avoids any noise while the sliding door driving system is operating. This is achieved by the deformable nature of the attachment tabs 30, 31, and 32.

The cable support 13 includes two centering members 17 adapted to facilitate the centering of the cable support 13 relative to the guide device 12 when the cable support 13 is fixed to the guide device 12. The centering members are situated, as represented in FIG. 8, on a face of the cable support 13 adapted to come into contact against the rear face 125 of the guide device 12. The centering members are adapted to cooperate with corresponding voids on the guide device 12.

FIG. 6 represents a perspective view of a driving system according to the invention. The driving system will be described mounted on a vehicle. This should not be considered to be limiting. The driving system includes a sliding door carriage 5 according to the invention. The driving system also includes a guide rail 2 along which the sliding door carriage 5 slides to be able to open or close a vehicle sliding door.

In FIG. 6, the sliding door carriage 5 is represented in the two limit positions: the position of the sliding door carriage 5 in the open position of the sliding door and the position of the sliding door carriage 5 in the closed position of the sliding door. The driving system however only includes a single sliding door carriage 5 sliding in the guide rail 2. The guide rail 2 includes a front end and a rear end. As can be seen in FIG. 1, the front end of the guide rail 2 can be curved so that the door can be offset relative to the body in order to be opened.

The driving system also includes a cable 40 for pulling the sliding door carriage 5, the cable 40 possibly being two cables, of which each cable has one end-piece situated on a drum 41, and the other end-piece situated on the fixing point 22 or 23. The cable 40 is wound onto a drum 41, and the drum 41 is adapted to be driven in rotation in one direction or the other by a gear motor 42. The drum 41 and the gear motor 42 are part of the driving system.

The cable 40 includes two cable strands 9 and 10 adapted to be inserted into the sliding door carriage 5 as explained above. The cable strands 9 and 10 are held in the sliding door carriage 5 by the sockets 25 housed in the fixing points 22 and 23 of the cable support 13 of the sliding door carriage 5. The cable strands 9 and 10 are housed in the grooves 7 and 8 of the sliding door carriage 5. The cable strands 9 and 10 cross over at the level of the carriage, as explained above. When the gear motor 42 is running, a pulling force is exerted on the cable 40. A pulling force is then exerted on one of the cable strands 9 or 10, depending on the sliding direction of the door, namely if the latter is being opened or closed. The socket 25 crimped on the cable strand 9 and 10 abuts in its corresponding fixing point 22 or 23, which allows for the sliding door carriage 5 to be pulled along the intermediate rail 2. The sliding door carriage 5 is displaced between two limit positions, which correspond to the open and closed positions of the sliding door. These limit positions are those represented in FIG. 6.

The guide rail 2 includes two piercings 45 through each of which passes a cable strand 9 and 10 situated in the extension of the fixing points 22 and 23. Thus, the cable strand 9 passes through the piercing 45 situated at the front of the rail relative to the direction of movement of the vehicle, whereas the cable strand 10 passes through the piercing 45 situated at the rear of the rail relative to the direction of movement of the vehicle.

Figure 7:
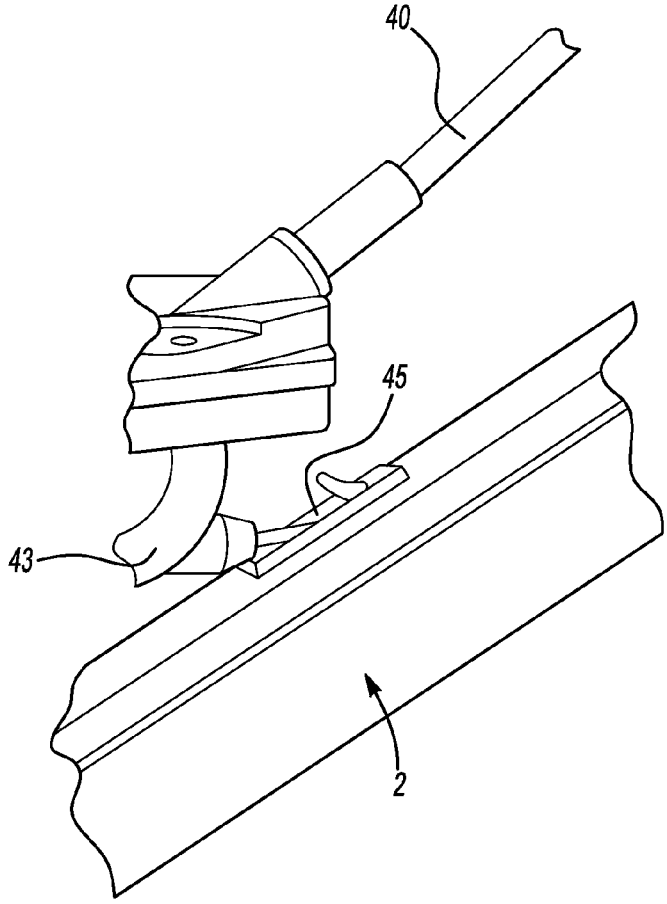
FIG. 7 illustrates a detail view of the driving system.

FIG. 7 represents a detail view of the driving system according to the invention. FIG. 7 represents in particular the intermediate rail 2 provided with a piercing 45, through which passes the cable 40. The piercing 45 is provided with a seal around its circumference to ensure a maximum seal-tightness inside the vehicle. The piercing 45 is, however, big enough not to hamper the circulation of the cable 40 through this piercing to limit the friction of the cable 40 against the circumference of the piercing 45 in order not to impede the correct sliding of the sliding door carriage 5 along the intermediate rail 2, and therefore the correct opening or closing of the sliding rear door 1.

The driving system also includes two transmitters 43 and 44, which are, for example, pulleys. The transmitters 43 and 44 are situated on the other side of the rail relative to the limit positions of the sliding door carriage 5. In this way, the distance between the transmitters 43 and 44 is substantially equal to the distance between the two limit positions of the sliding door carriage 5, in particular when the rail is linear. The distance between the transmitters 43 and 44 is therefore reduced compared to the prior art described at the beginning of the present application. The bulk of the driving system in the body is therefore reduced, which provides a space saving in the body shell of the vehicle. The transmitters 43 and 44 define a cable 40 between the piercings 45 of the intermediate rail 2 and the drum 41.

The invention also relates to a vehicle including the driving system as proposed and the sliding rear door 1, the sliding door carriage 5 being fixed to the sliding rear door 1. The driving system is of reduced bulk due to the fixing points 22 and 23 for fixing cable strands 9 and 10 offset toward the rear of the sliding door carriage 5 relative to the driving direction of the sliding door carriage 5.

The invention also relates to a method of mounting a sliding door driving system. The method includes the steps of providing a guide device 12, providing a cable support 13 including a first fixing point 22 for fixing a first cable strand for driving in a first direction and a second fixing point 23 for fixing a second cable strand for driving in a second direction, each fixing point 22 and 23 being offset toward the rear of the sliding door carriage 5 relative to the direction of driving by the respective cable strand 9 and 10. The method includes the steps of providing a cable 40, inserting the cable support 13 into the guide device 12, fixing the cable support 13 to the guide device 12 of the sliding door carriage 5, and fixing the cable strands 9 and 10 of the cable to the sliding door carriage 5. This method makes it possible to mount a sliding door driving system in the body of a vehicle which is of reduced bulk.

The guide device 12 includes attachment features 30, 31 and 32 for attaching the cable support 13 to the guide device 12. The attachment features 30, 31 and 32 are tabs adapted to be deformed to fix the cable support 13 to the guide device 12. The step of fixing the cable support to the guide device of the sliding door carriage 5 includes a step of deforming the attachment tabs 30, 31 and 32 to fix the cable support 13 to the guide device 12. Thus, a simple mounting of the driving system is achieved, with no fixing features other than the deformable attachment tabs present on the sliding door carriage 5.

Figure 9:
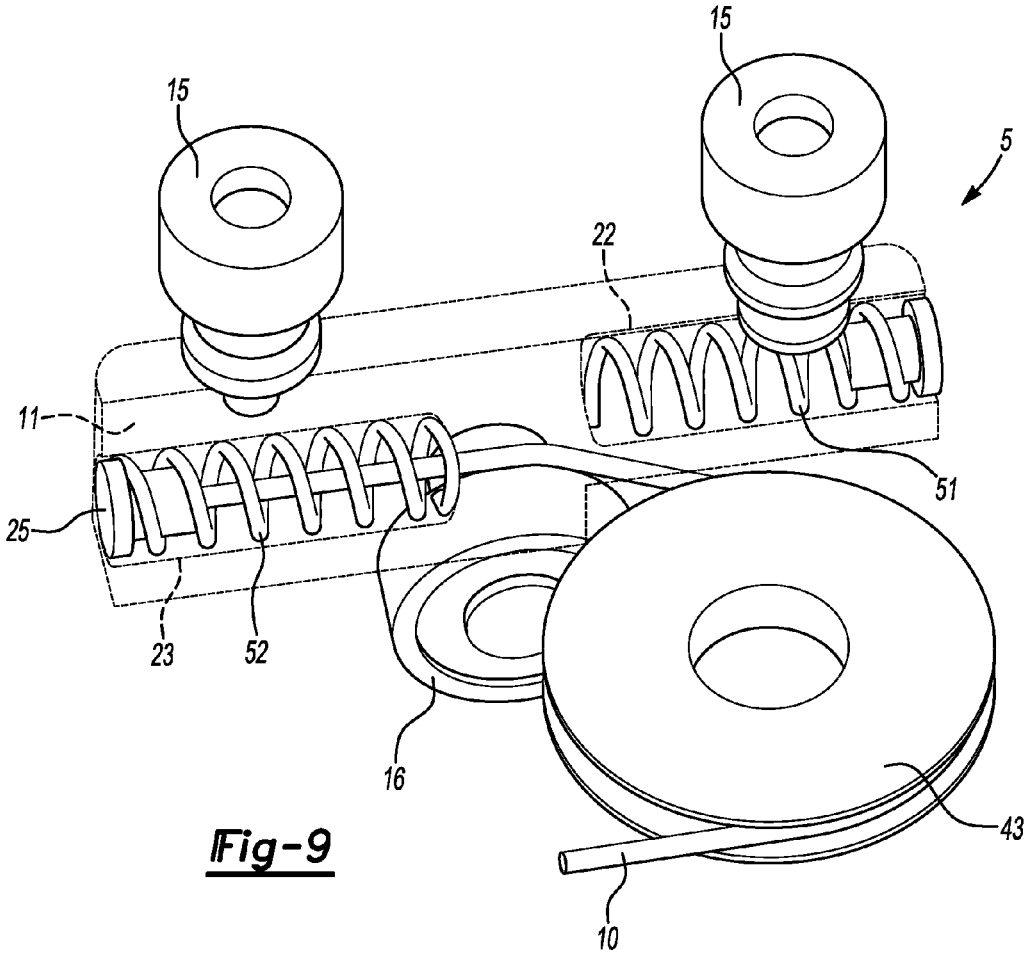
FIG. 9 illustrates a perspective view of a carriage according to one of the preceding figures.

FIG. 9 shows a perspective view of a sliding door carriage 5 in the two limit positions according to another embodiment. The inside of the sliding door carriage 5 is represented by transparency. In the embodiment of FIG. 9, the driving system includes one or more tensioners 51 and 52. For example, the tensioner(s) 51 and 52 is/are on the sliding door carriage 5. This makes it possible in particular to adapt the length of the cable to the driving system. In particular, the tensioners 51 and 52 make it possible to facilitate the mounting of the cable strands 9 and 10 in the driving system. Furthermore, the tensioners 51 and 52 make it possible to maintain a substantially constant tension of the cable throughout the life of the driving system. In effect, the tensioners 51 and 52 provide a way of offsetting the appearance of play in the driving system during the use of this system.

The tensioner or tensioners 51 and 52 can be at the ends of one or each of the cable strands 9 and 10. According to FIG. 9, each of the fixing points 22 and 23 of the cable strands 9 and 10 is linked to the carriage by a tensioner 51 and 52. The tensioners 51 and 52 are, for example, at the fixing points 22 and 23. The tensioner 51 is in the fixing point 22, and the tensioner 52 is in the fixing point 23.

The tensioners 51 and 52 are, for example, a spring. According to FIG. 9, the cable strands 9 and 10 are each inserted into a spring 51 and 52. The socket 25 of each cable strand 9 and 10 is retained by the spring. For example, the socket 25 can have a contact surface with the spring greater than that of the diameter of the spring 51 and 52. On starting, depending on one or other of the driving directions of the sliding door carriage 5, the socket 25 stresses the spring 51 or 52 in compression against the bottom of the respective recess. The spring or springs 51 and 52 also make it possible to damp the starting of the driving system. The spring or springs 51 and 52 therefore make it possible to have a more flexible startup in order to limit major mechanical stresses on the sliding door driving system assembly. Reducing these stresses reduces the wear of this system.

Everything described above regarding FIG. 2 and FIGS. 3 to 5 and 8 is also valid for the embodiment of FIG. 9. Furthermore, FIG. 9 shows another arrangement of the grooves 7 and 8 equally applicable to the other figures, and vice versa. According to FIG. 9, the grooves are parallel to each other. The grooves 7 and 8 extend in the direction of displacement of the sliding door carriage 5 along the rail. However, the tensioners 51, 52, described previously, apply equally to the grooves of FIG. 9 and to the grooves described in relation to the other figures.

Obviously, the present invention is not limited to the embodiments described by way of example; thus, the invention is not limited to vehicles equipped with a sliding rear door but may also relate to a motor vehicle fitted with a sliding front door. Similarly, the invention is not limited to vehicles fitted with three guide rails but can apply to vehicles including more or fewer sliding door guide rails. Nor is the invention limited to a driving system situated at the level of the intermediate rail. The driving system could be at the level of the top rail or of the bottom rail.

The foregoing description is only exemplary of the principles of the invention. Many modifications and variations are possible in light of the above teachings. It is, therefore, to be understood that within the scope of the appended claims, the invention may be practiced otherwise than using the example embodiments which have been specifically described. For that reason the following claims should be studied to determine the true scope and content of this invention.

What is claimed is:

1. A sliding door carriage comprising:

a cable support having a first fixing point for fixing a first cable strand to the cable support wherein a first portion of the first cable strand is received within a first groove of the cable support and a second portion of the first cable strand extends from the cable support in a first direction;

a second fixing point for fixing a second cable strand to the cable support wherein a first portion of the second cable strand is received within a second groove of the cable support and a second portion of the second cable strand extends from the cable support in a second direction, wherein each of the first fixing point and the second fixing point are offset from each other; and wherein the first portion of the first cable strand and the first groove are located in a first plane and the first portion of the second cable strand and the second groove are located in a second plane, the first plane being vertically offset from the second plane and wherein the first plane is parallel to the second plane and wherein a path of the first portion of the first cable strand and the first groove in the cable support is angularly off set with respect to a path of the first portion of the second cable strand and the second groove.

2. The sliding door carriage according to claim 1, wherein the cable support is configured to be inserted into a guiding device for guiding the sliding door carriage along a rail, wherein the cable support is fixed to the guide device by an attachment feature.

3. The sliding door carriage according to claim 2, wherein the guide device further comprises a plurality of resilient tabs for securing the cable support inside the guide device.

4. The sliding door carriage according to claim 1, wherein each of the first fixing point and the second fixing point is linked to the sliding door carriage by a tensioner.

5. The sliding door carriage as in claim 1, wherein the cable support is inserted into a guide device configured for guiding the sliding door carriage along a rail, wherein the guide device further comprises a plurality of resilient tabs for retaining the cable support inside the guide device, wherein the plurality of resilient tabs must be flexed from a first position to a second position so that the cable support can be inserted into the guide device, wherein the plurality of resilient tabs return to the first position after the cable support is inserted into the guide device.

6. The sliding door carriage as in claim 5, wherein at least two of the plurality of resilient tabs are located proximate to distal ends of the cable support when it is inserted into the guide device.

7. The sliding door carriage as in claim 6, wherein another one of the plurality of resilient tabs is located between the distal ends of the cable support when it is inserted into the guide device.

8. The sliding door carriage according to claim 1, wherein the first cable strand extends outwardly away from a lateral side of the cable support and the second cable strand extends outwardly away from the lateral side of the cable support.

9. The sliding door carriage according to claim 8, wherein the lateral side extends between the first fixing point and the second fixing point.

10. The sliding door carriage according to claim 9, wherein the cable support is configured to be inserted into a guiding device for guiding the sliding door carriage along a rail, wherein the cable support is fixed to the guide device by an attachment feature and wherein the lateral side is uncovered by the guiding device.

11. The sliding door carriage according to claim 8, wherein the cable support is configured to be inserted into a guiding device for guiding the sliding door carriage along a rail, wherein the cable support is fixed to the guide device by an attachment feature and wherein the lateral side is uncovered by the guiding device.

12. A sliding door driving system for vehicles, the sliding door driving system comprising:

a gear motor;

a sliding door carriage comprising a cable support having a first fixing point for fixing a first cable strand of a cable to the cable support wherein a first portion of the first cable strand is received within first groove of the cable support and a second portion of the first cable strand extends from the cable support for driving in a first direction;

a second fixing point for fixing a second cable strand of the cable to the cable support wherein a first portion of the second cable strand is received within a second groove of the cable support and a second portion of the second cable strand extends from the cable support for driving in a second direction, wherein each of the first fixing point and the second fixing point are offset from each other; and wherein the first portion of the first cable strand and the first groove are located in a first plane and the first portion of the second cable strand and the second groove are located in a second plane, the first plane being vertically offset from the second plane and wherein the first plane is parallel to the second plane and wherein a path of the first portion of the first cable strand and the first groove in the cable support is angularly off set with respect to a path of the first portion of the second cable strand and the second groove.

13. The sliding door driving system according to claim 12, comprising two transmitters defining a cable path, wherein the sliding door carriage is opposite one of the two transmitters when the sliding door carriage is in a limit position.

14. The sliding door driving system according to claim 12, further comprising: a guiding device, wherein the cable support is configured to be inserted into the guiding device, the guiding device being configured for guiding the sliding door carriage along a rail, the sliding door carriage having at least two piercings, and one of the first cable strand and the second cable strand passes through one of the at least two piercings each of which are situated in an extension of one of the first fixing point and the second fixing point.

15. The sliding door driving system as in claim 14, wherein the guide device further comprises a plurality of resilient tabs for retaining the cable support inside the guide device, wherein the plurality of resilient tabs must be flexed from a first position to a second position so that the cable support can be inserted into the guide device, wherein the plurality of resilient tabs return to the first position after the cable support is inserted into the guide device.

16. The sliding driving system as in claim 15, wherein at least two of the plurality of resilient tabs are located proximate to distal ends of the cable support when it is inserted into the guide device and wherein another one of the plurality of resilient tabs is located between the distal ends of the cable support when it is inserted into the guide device.

17. The sliding door driving system as in claim 12, wherein the cable support is inserted into a guide device configured for guiding the sliding door carriage along a rail, wherein the guide device further comprises a plurality of resilient tabs for retaining the cable support inside the guide device, wherein the plurality of resilient tabs must be flexed from a first position to a second position so that the cable support can be inserted into the guide device, wherein the plurality of resilient tabs return to the first position after the cable support is inserted into the guide device.

18. The sliding door driving system as in claim 17, wherein at least two of the plurality of resilient tabs are located proximate to distal ends of the cable support when it is inserted into the guide device and wherein another one of the plurality of resilient tabs is located between the distal ends of the cable support when it is inserted into the guide device.

19. The sliding door driving system as in claim 12, wherein the first cable strand extends outwardly away from a lateral side of the cable support and the second cable strand extends outwardly away from the lateral side of the cable support.

20. The sliding door driving system as in claim 19, wherein the lateral side extends between the first fixing point and the second fixing point.

21. The sliding door driving system as in claim 20, wherein the cable support is configured to be inserted into a guiding device for guiding the sliding door carriage along a rail, wherein the cable support is fixed to the guide device by an attachment feature and wherein the lateral side is uncovered by the guiding device.

22. A vehicle comprising:

a sliding door driving system including:

a gear motor;

a sliding door carriage, comprising: a cable support having a first fixing point for fixing a first cable strand of a cable to the cable support wherein a first portion of the first cable strand is received within a first groove of the cable support and a second portion of the first cable strand extends from the cable support for driving in a first direction;

a second fixing point for fixing a second cable strand of the cable to the cable support wherein a first portion of the second cable strand is received within a second groove of the cable support and a second portion of the second cable strand extends from the cable support for driving in a second direction, wherein each of the first fixing point and the second fixing point are offset from each other; and wherein the first portion of the first cable strand and the first groove are located in a first plane and the first portion of the second cable strand and the second groove are located in a second plane, the first plane being vertically offset from the second plane and wherein the first plane is parallel to the second plane and wherein a path of the first portion of the first cable strand and the first groove in the cable support is angularly off set with respect to a path of the first portion of the second cable strand and the second groove, the cable being secured to the gear motor, wherein movement of the gear motor moves the sliding door carriage in a rail of the vehicle via the cable; and a sliding door slidably driven by the sliding door driving system, wherein the sliding door carriage is fixed to the sliding door.

23. The vehicle as in claim 22, wherein the cable support is inserted into a guide device configured for guiding the sliding door carriage along the rail, wherein the guide device further comprises a plurality of resilient tabs for retaining the cable support inside the guide device, wherein the plurality of resilient tabs must be flexed from a first position to a second position so that the cable support can be inserted into the guide device, wherein the plurality of resilient tabs return to the first position after the cable support is inserted into the guide device.

24. A method of mounting a sliding door driving system, the method comprising the steps of:

securing a first cable strand of a cable to a first point of a cable support;

securing a second cable strand of the cable to a second point of the cable support, wherein a first portion of the first cable strand is received within a first groove of the cable support and a second portion of the first cable strand extends from the cable support for driving in a first direction and wherein a first portion of the second cable strand is received within a second groove of the cable support and a second portion of the second cable strand extends from the cable support for driving in a second direction, wherein each of the first fixing point and the second fixing point are offset from each other; and wherein the first portion of the first cable strand and the first groove are located in a first plane and the first portion of the second cable strand and the second groove are located in a second plane, the first plane being vertically offset from the second plane and wherein the first plane is parallel to the second plane and wherein a path of the first portion of the first cable strand and the first groove in the cable support is angularly off set with respect to a path of the first portion of the second cable strand and the second groove.

25. The method according to claim 24, wherein the cable support is configured to be inserted into a guiding device for guiding the sliding door carriage along a rail, and wherein the cable support being is fixed to the guide device by an attachment feature.

26. The method as in claim 25, wherein the guide device further comprises a plurality of resilient tabs for affixing securing the cable support inside the guide device.

27. The method according to claim 24, wherein the first cable strand extends outwardly away from a lateral side of the cable support and the second cable strand extends outwardly away from the lateral side of the cable support and wherein the lateral side extends between the first fixing point and the second fixing point.

28. The method as in claim 27, wherein the cable support is configured to be inserted into a guiding device for guiding the sliding door carriage along a rail, wherein the cable support is fixed to the guide device by an attachment feature and wherein the lateral side is uncovered by the guiding device.

* * * * *